US010039357B2

(12) United States Patent
Wu

(10) Patent No.: US 10,039,357 B2
(45) Date of Patent: Aug. 7, 2018

(54) EXPANDABLE BAG

(71) Applicant: Simon Wu Wu, Santiago (CL)

(72) Inventor: Simon Wu Wu, Santiago (CL)

(73) Assignee: Simon Wu Wu, Santiago (CL)

( * ) Notice: Subject to any disclaimer, the term of this patent is extended or adjusted under 35 U.S.C. 154(b) by 0 days.

(21) Appl. No.: 15/276,718

(22) Filed: Sep. 26, 2016

(65) Prior Publication Data

US 2017/0265612 A1 Sep. 21, 2017

Related U.S. Application Data

(60) Provisional application No. 62/311,111, filed on Mar. 21, 2016.

(51) Int. Cl.

| | |
|---|---|
| ***A45C 7/00*** | (2006.01) |
| ***A45C 3/00*** | (2006.01) |
| ***A45C 13/10*** | (2006.01) |

(52) U.S. Cl.

CPC ..... *A45C 7/0063* (2013.01); *A45C 3/00* (2013.01); *A45C 7/0077* (2013.01); *A45C 13/103* (2013.01); *A45C 13/1046* (2013.01); *A45C 2003/007* (2013.01)

(58) Field of Classification Search

CPC ..... A45C 7/006; A45C 7/0059; A45C 7/1063; A45C 13/1096; A45C 7/0063; A45C 12/1046

USPC ..... 190/103, 104, 107; 383/2, 38, 66, 72

See application file for complete search history.

(56) References Cited

U.S. PATENT DOCUMENTS 1,207,533 A * 12/1916 Gamble ..... A45C 7/0022 150/111
1,269,276 A * 6/1918 Harris ..... A47G 9/0253 206/579
3,746,066 A * 7/1973 McIntyre ..... A45C 7/0063 150/107
3,838,758 A * 10/1974 Brown ..... B65D 29/00 383/2
4,096,978 A * 6/1978 Noice ..... A45F 3/04 224/640
5,427,453 A * 6/1995 Cloessner ..... A45C 3/00 190/109
5,692,660 A * 12/1997 Stewart ..... A45C 3/00 190/103
5,704,528 A * 1/1998 Faure ..... A45C 7/0063 150/105

(Continued)

*Primary Examiner* — Sue A Weaver

(74) *Attorney, Agent, or Firm* — Kali Law Group, P.C.

(57) ABSTRACT

An expandable/collapsible bag that can be configured into three different sizes—small medium, and large. It is of cylindrical shape, has three interconnected chambers, a zipper running along its entire length, three handles on top, and two drawstrings. When the bag is in its large configuration, all chambers are expanded and accessible. The two side chambers can collapse inwards into the middle chamber, allowing the size of the bag to be reduced. This can be done by collapsing and pushing the material of each side chamber into chamber B past the line of their adjacent drawstrings. Once the collapsed material from each side chamber is completely inside chamber B, then, their adjacent drawstrings can be cinched or pulled tight to close the ends of the bag. This keeps the collapsed material from the side chambers inside the middle chamber and prevents the bag from expanding when in use.

6 Claims, 15 Drawing Sheets

(56) References Cited

U.S. PATENT DOCUMENTS

| | | | | | |
|---|---|---|---|---|---|
| 6,085,695 | A * | 7/2000 | Miller | A01K 27/006 | 119/795 |
| 6,126,054 | A * | 10/2000 | Riemer | A45C 13/1046 | 224/601 |
| 7,344,308 | B2 * | 3/2008 | Meyer | A63B 57/60 | 383/41 |
| 8,074,853 | B1 * | 12/2011 | Hirshberg | A45C 3/001 | 206/315.1 |
| 8,801,286 | B2 * | 8/2014 | Tatsuno | A45C 3/001 | 383/117 |
| 2005/0084182 | A1 * | 4/2005 | Penson | D06F 95/004 | 383/38 |
| 2006/0102673 | A1 * | 5/2006 | Collier | A45C 7/0068 | 224/581 |
| 2007/0164064 | A1 * | 7/2007 | Nathan | A45C 5/14 | 224/153 |
| 2009/0026098 | A1 * | 1/2009 | Tierney | A01M 31/008 | 206/315.11 |

* cited by examiner

EXPANDABLE BAG

CROSS REFERENCE TO RELATED APPLICATIONS

This application claims priority from U.S. Patent Application Ser. No. 62/311,111, entitled "Expandable Bag", filed on 21 Mar. 2016. The benefit under 35 USC § 119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to the field of soft luggage. More specifically, the present invention is related to collapsible soft bags, such as duffel bags, school bags, travel bags, utility bags, and the like.

BACKGROUND OF THE INVENTION

The global luggage market includes bags for packaging of personal belongings. The market can be broadly segmented into casual bags, travel bags, and business bags. These segments include several types of luggage (such as spinner bags, suitcases, duffel bags, messenger bags, carry-on bags, expandable bags, and others) to suit various consumer needs.

When it comes to luggage, users must not only decide how it will be used, but they must consider size, type, and number of storage compartments. Many buyers, elect for a collapsible or expandable bag in hopes that it will meet many needs such as avoiding buying more luggage later when more size is necessary, while be smaller and easier to carry and transport when less size is needed.

The expandable/collapsible bag market has many products, and each has a shortcoming that makes it undesirable for many buyers. Many of the bags taught in the prior art suffer from limited access when they are collapsed, and many have complicated zippers, pouches, and combinations that make them difficult to use or remember how to use, as well as adding unnecessary weight.

Therefore, what is needed is a simple expandable/collapsible bag that has an operating mechanism that is simple, easy to use, and does not add excessive weight or structure to the bag.

SUMMARY OF THE INVENTION

The present invention is an expandable/collapsible bag. In a preferred embodiment, the bag consists of a multi-compartment cylindrical shaped duffel bag with two drawstrings, a zipper running the length of the long axis of the bag, and one or more handles. In another embodiment, there are one or more shoulder straps as well. In its fully expanded position/embodiment there are three chambers, chambers A, B, and C, and drawstrings 1 and 2. In this embodiment, the bag is cylindrical in shape, has a plurality of handles, and zippers, although the bag could be comprised of more or less handles, and more or less chambers.

The design is an expandable/collapsible bag that can be configured into three different sizes—small medium, and large. It is of cylindrical shape, has three interconnected chambers, a zipper running along its entire length, three handles on top, and two drawstrings.

When the bag is in its large configuration, all chambers, A, B, and C, are expanded and accessible. Here, handle B can be used to carry the bag in this configuration, as it is centered at the top.

Collapsing only chamber A transforms the bag to a first medium configuration, where the bag is the length of chambers B and C, and chambers B and C are expanded and accessible. Here, handle C can be used to carry the bag since, in this configuration, handle C is centered at the top.

Collapsing only chamber C transforms the bag to a second medium configuration, where the bag is the length of chamber A and B, and chambers A and B are expanded and accessible. Here, handle A can be used to carry the bag since, in this configuration, handle A is centered at the top.

In another embodiment, the two side chambers, A and C, can collapse inwards into chamber B, allowing the size of the bag to be reduced. Collapsing both side chambers, A and C, transforms the bag to its small configuration. In this configuration, the bag is only the size of chamber B, and only chamber B is expanded and accessible. Here, handle B can be used to carry the bag since, in this configuration, handle B is centered at the top.

BRIEF DESCRIPTION OF THE DRAWINGS

The accompanying drawings, which are incorporated herein form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Figure 1:
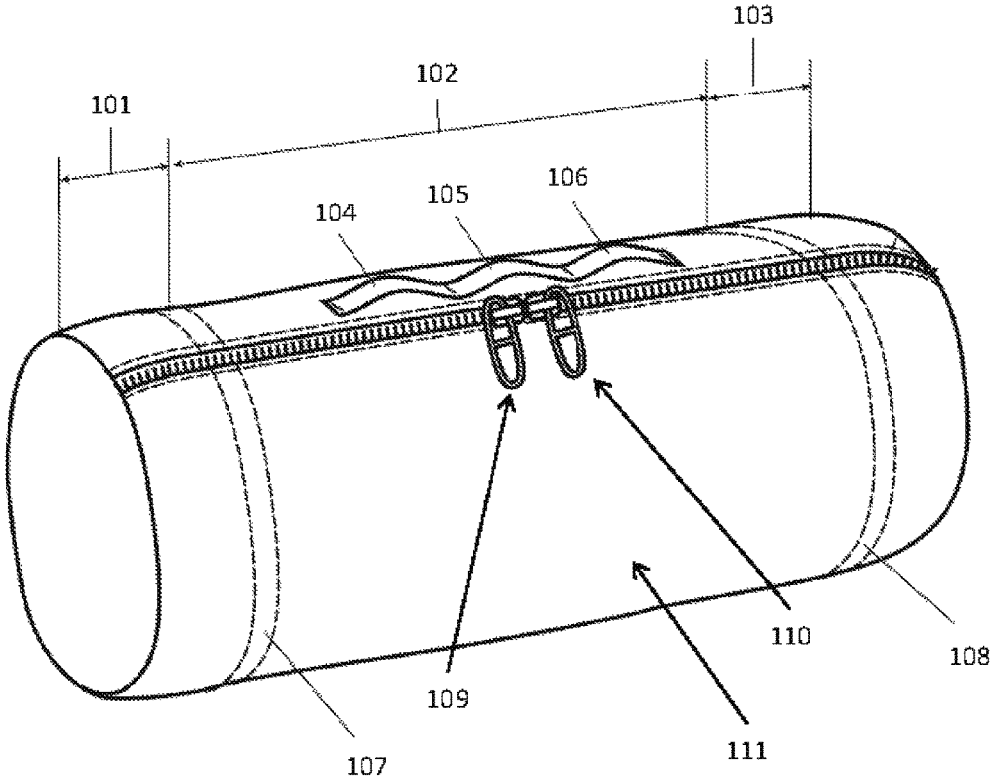
FIG. 1 illustrates a three chamber embodiment of the bag of the present invention in a fully expanded position where all the chambers are accessible.
Figure 2:
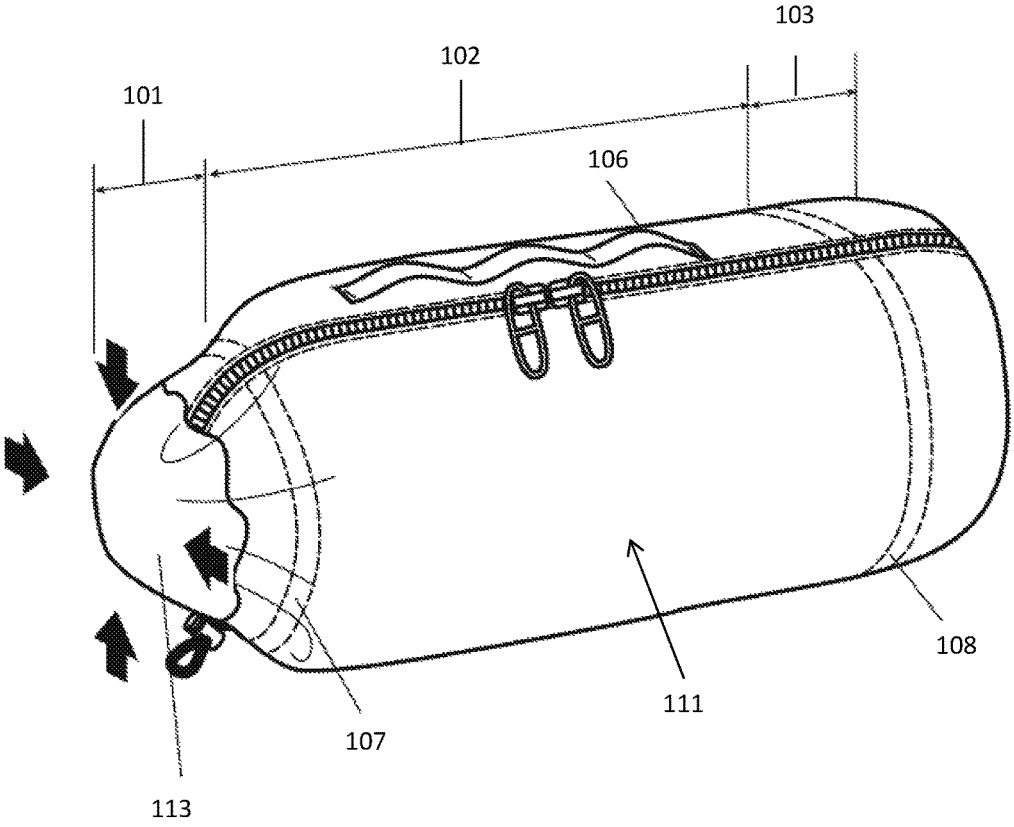
FIG. 2 illustrates a three chamber embodiment of the bag of the present invention in a partially expanded position where a side chamber is being collapsed into its adjacent middle chamber.
Figure 3:
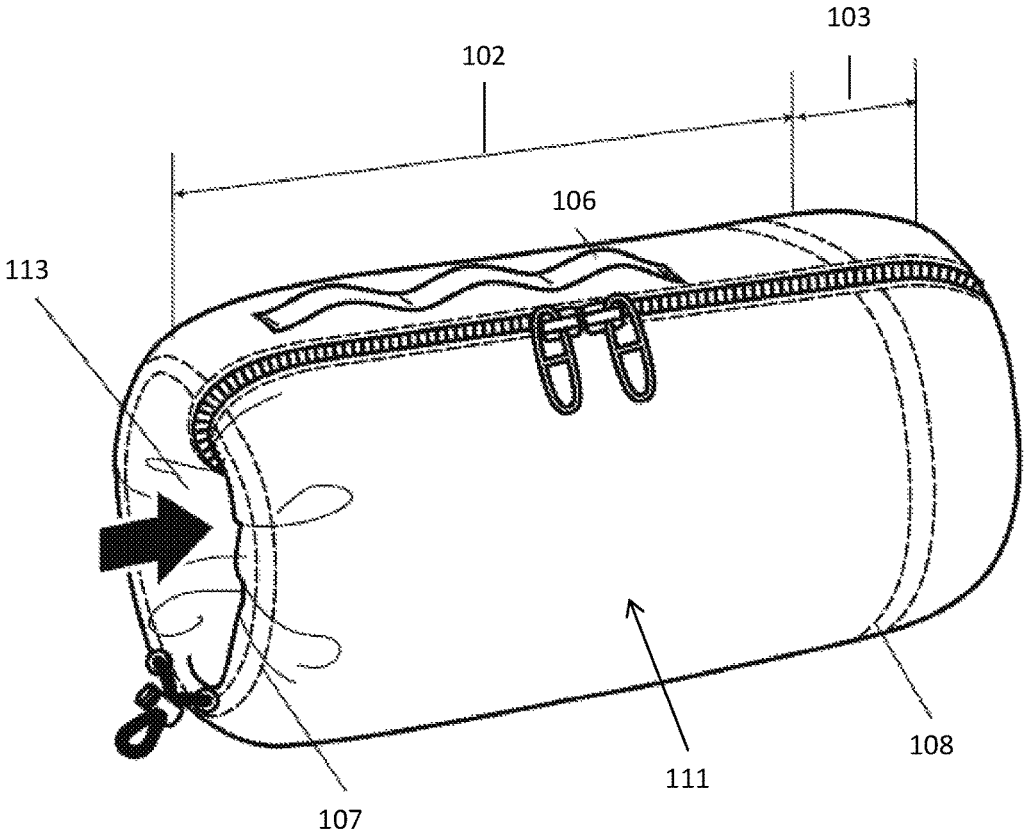
FIG. 3 illustrates a two chamber embodiment of the bag of the present invention in a partially expanded position where a side chamber is being collapsed into its adjacent middle chamber.
Figure 4:
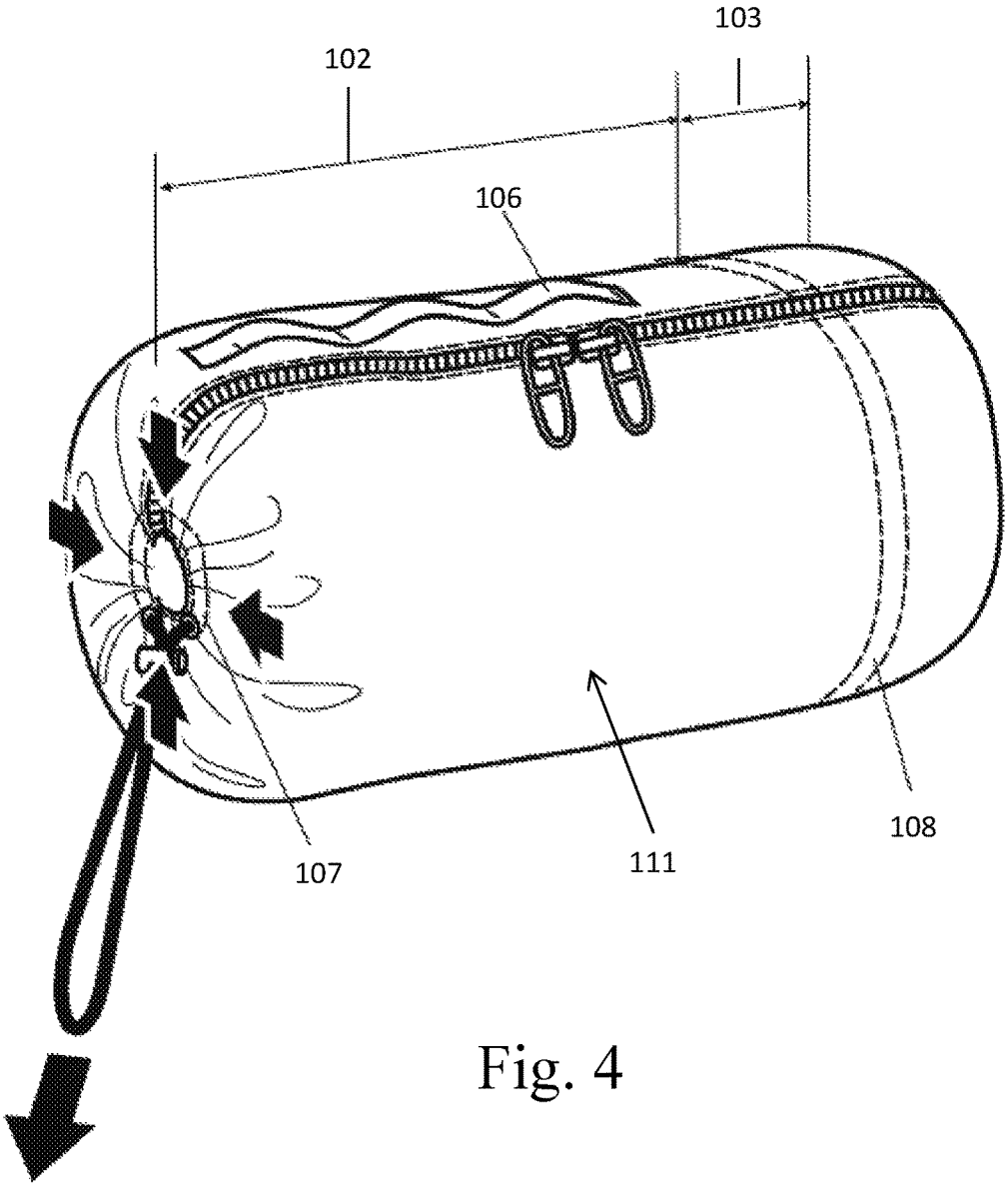
FIGS. 4-6 illustrate a two chamber embodiment of the bag of the present invention in a partially expanded position where a side chamber is collapsed into its adjacent middle chamber and a drawstring is used to trap the collapsed material of the side chamber inside its adjacent middle chamber.
Figure 5:
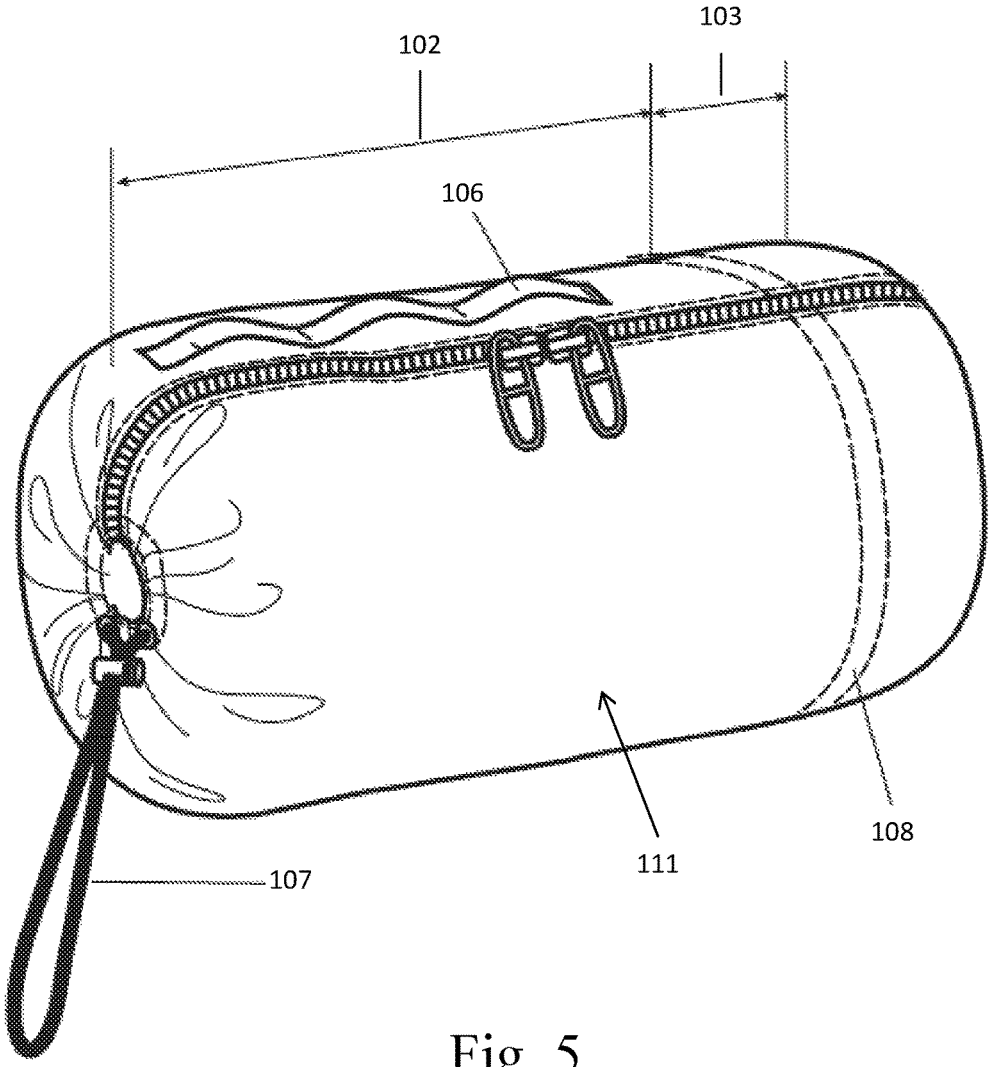
Figure 6:
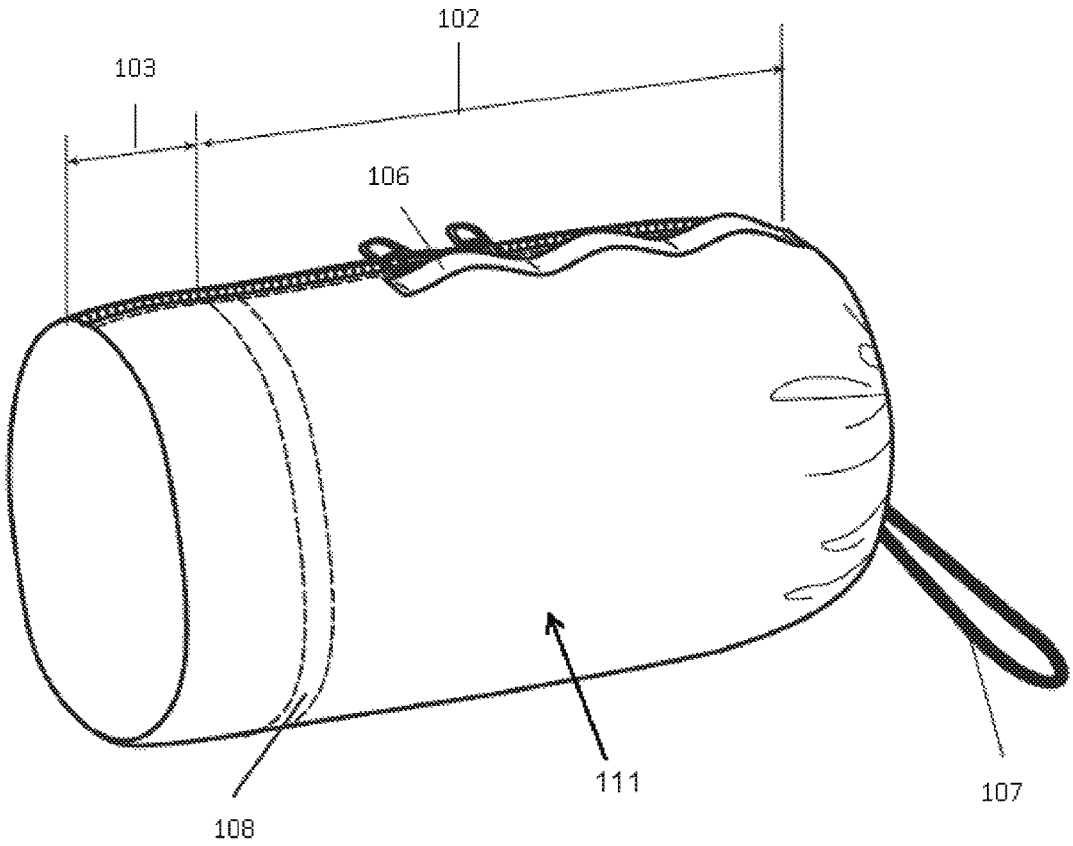
Figure 7:
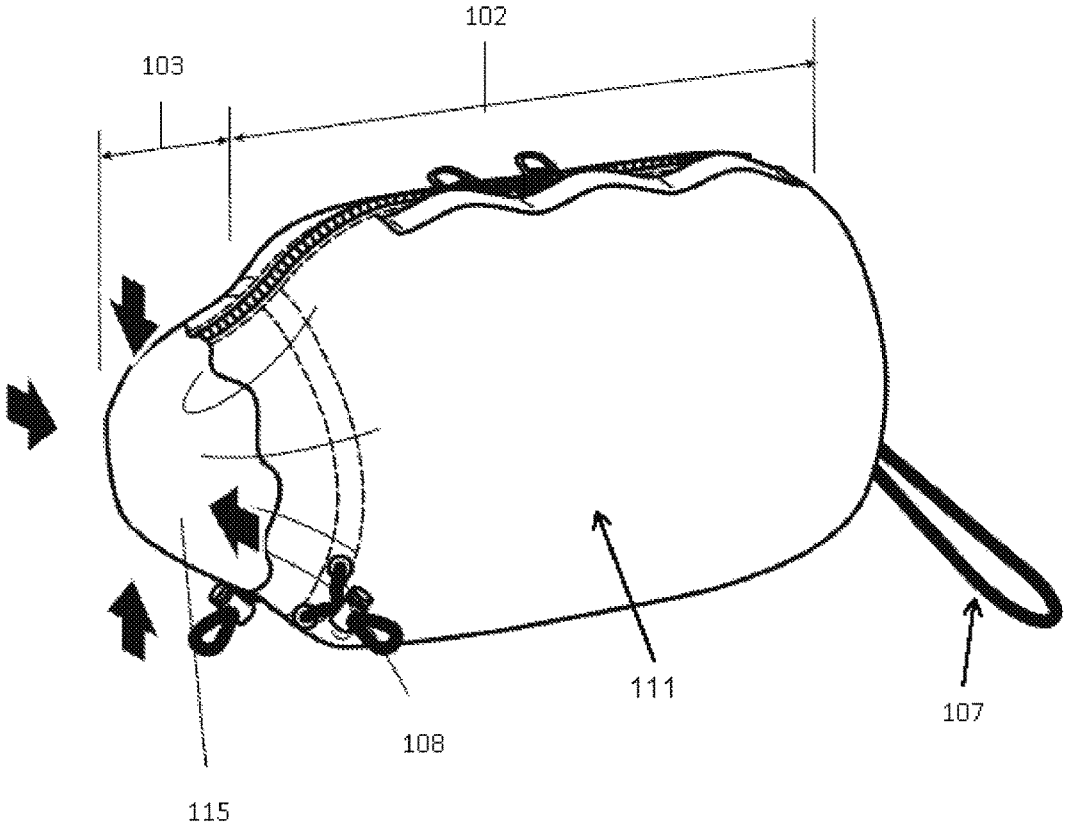
FIG. 7 illustrates a two chamber embodiment of the bag of the present invention in a partially expanded position where a second side chamber is collapsed into its adjacent middle chamber.
Figure 8:
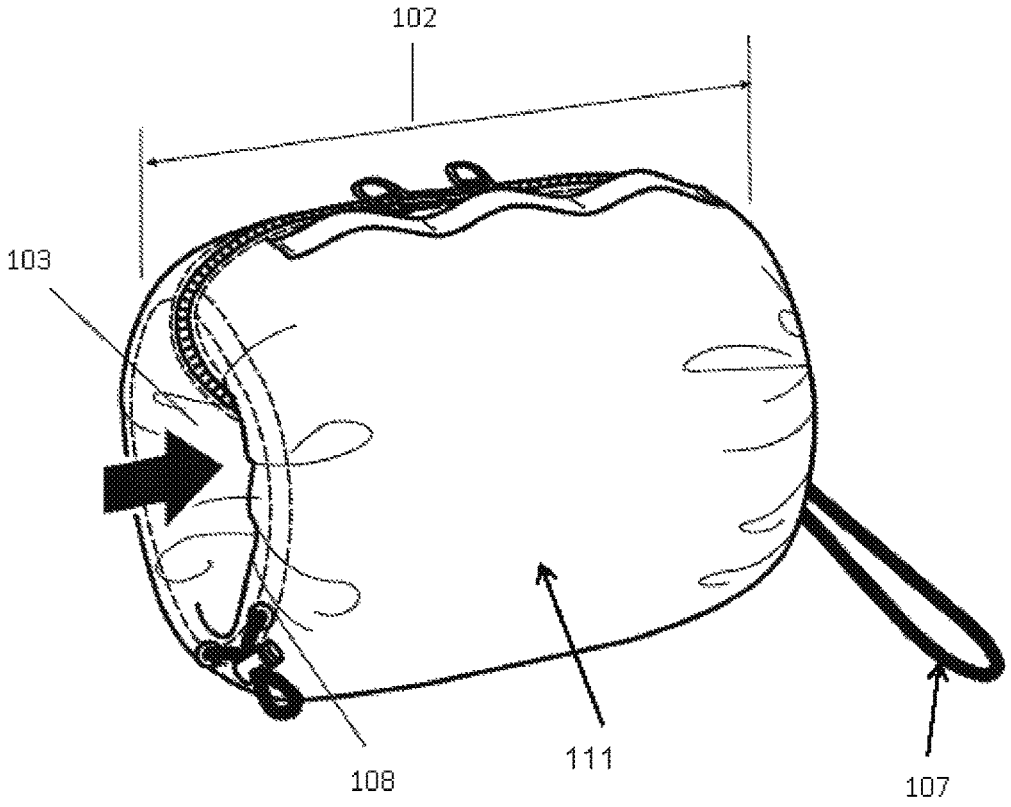
FIG. 8 illustrates a single chamber embodiment of the bag of the present invention in a partially expanded position where a second side chamber is collapsed into its adjacent middle chamber.
Figure 9:
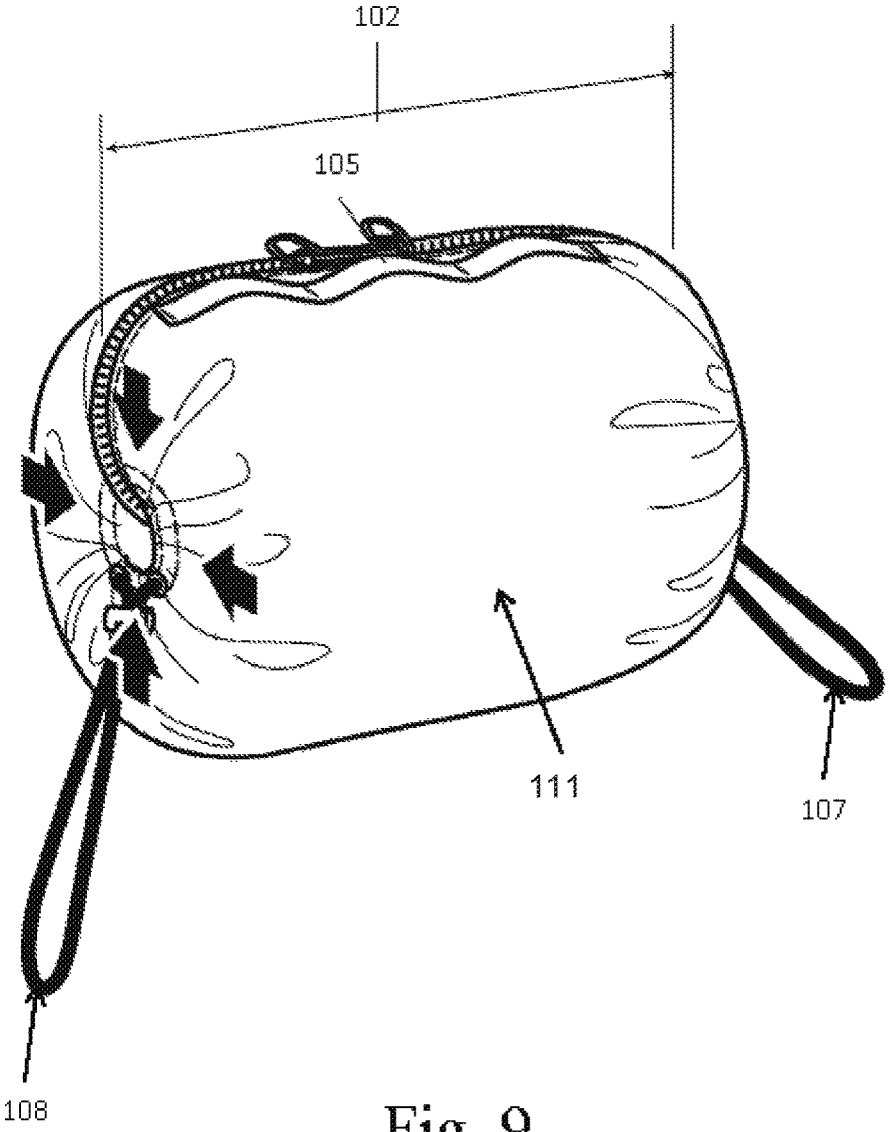
FIGS. 9-10 illustrate a single chamber embodiment of the bag of the present invention in a partially expanded position where a both side chambers are collapsed into the middle chamber and two drawstrings are used to trap the collapsed material of the both side chambers inside the middle chamber.
Figure 10:
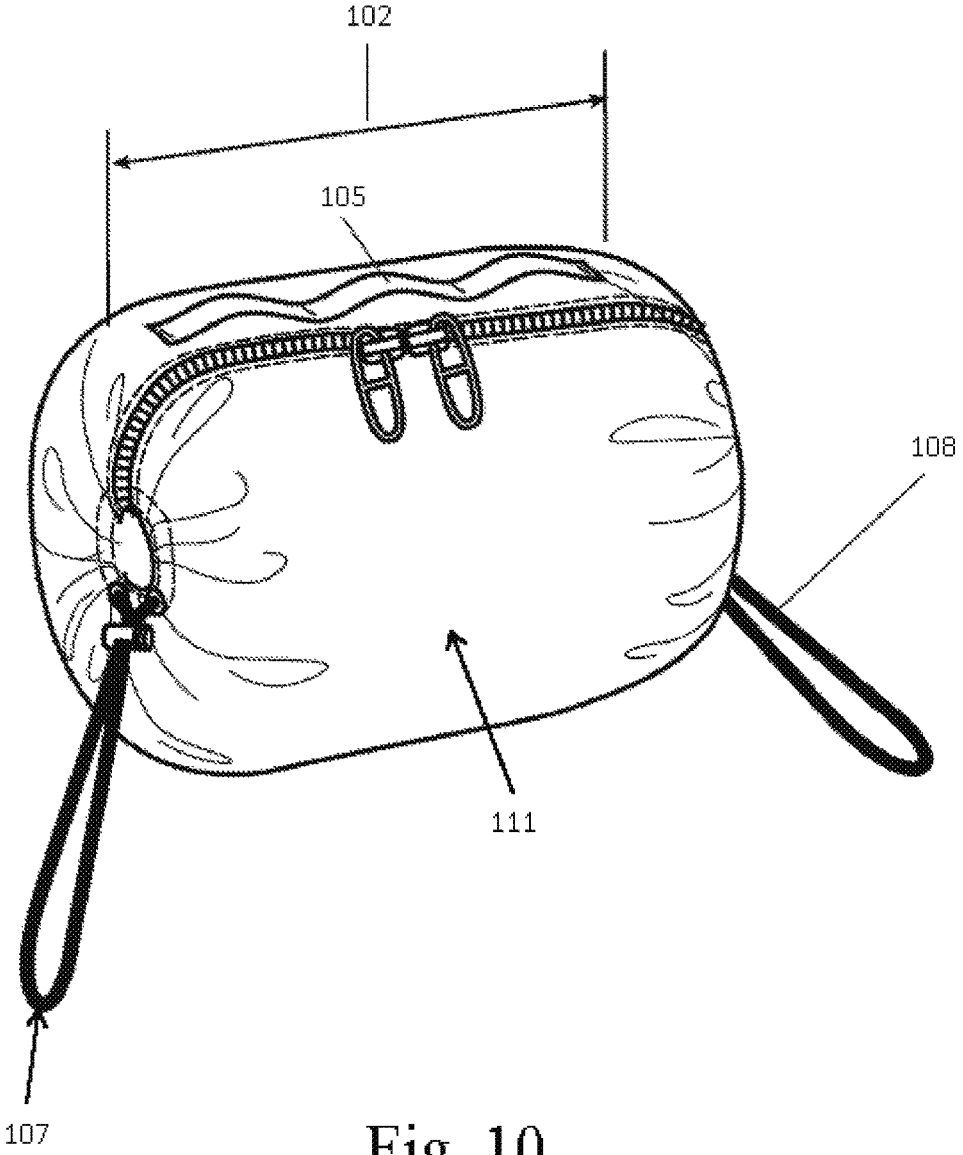
Figure 11:
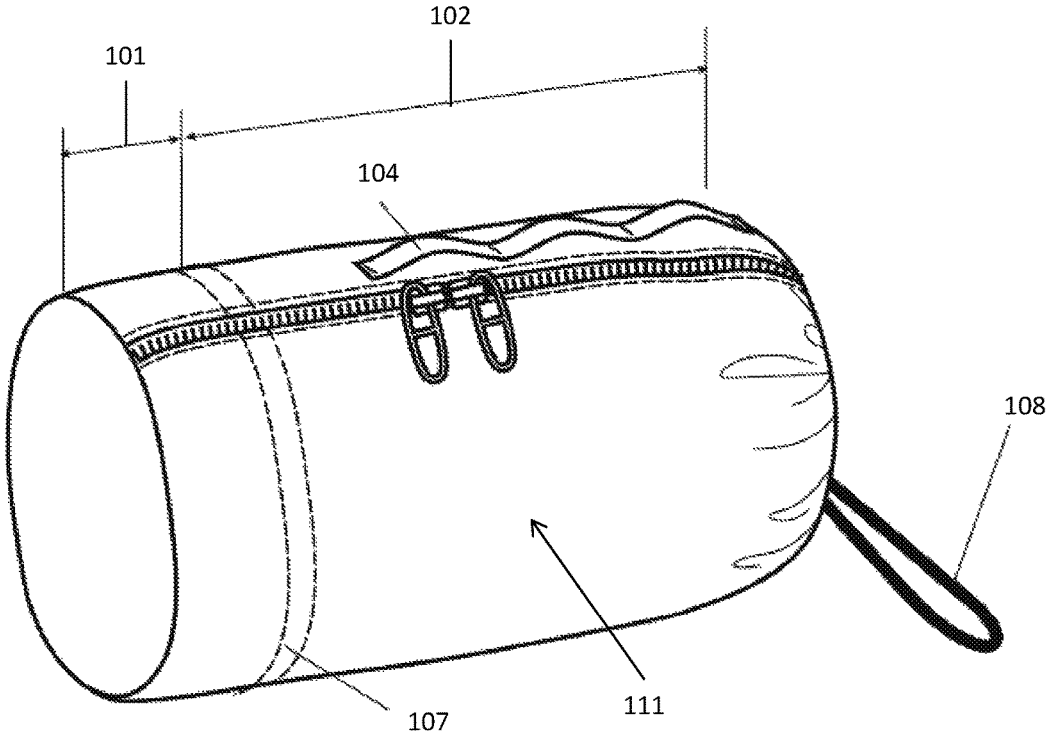
FIG. 11 is an illustrative representation of a collapsible bag in accordance with embodiments of the present invention.
Figure 12:
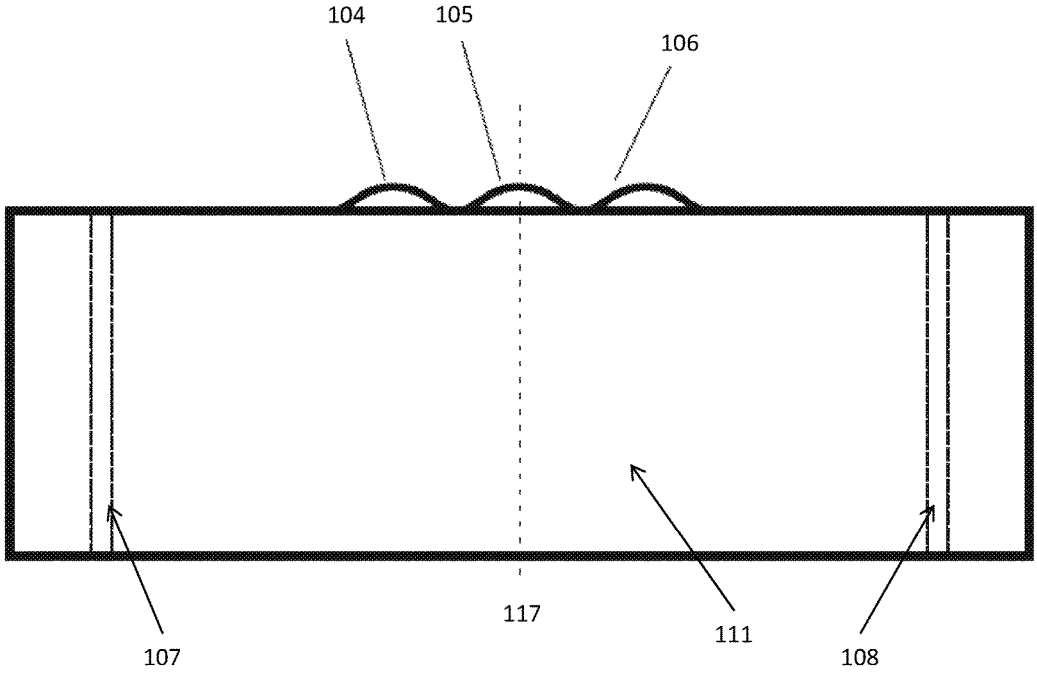
FIG. 12 is an illustrative side-view representation of a collapsible bag in accordance with embodiments of the present invention.
Figure 13:
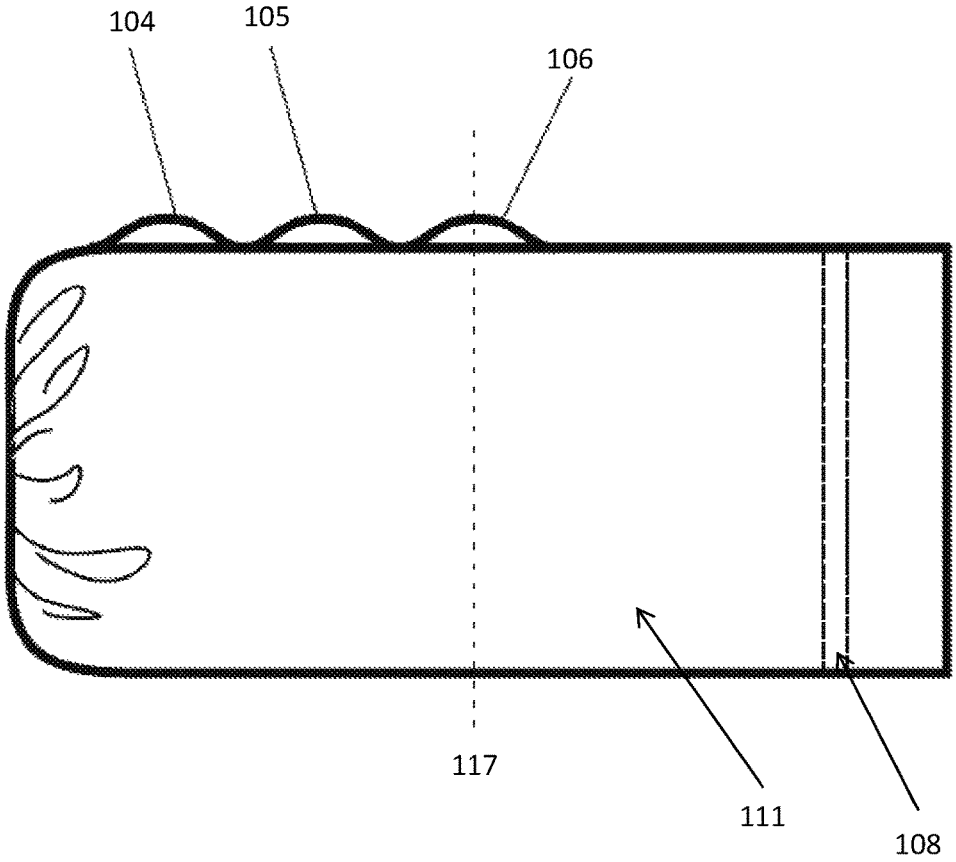
FIG. 13 is an illustrative side-view representation of a collapsible bag having one chamber collapsed in accordance with embodiments of the present invention.
Figure 14:
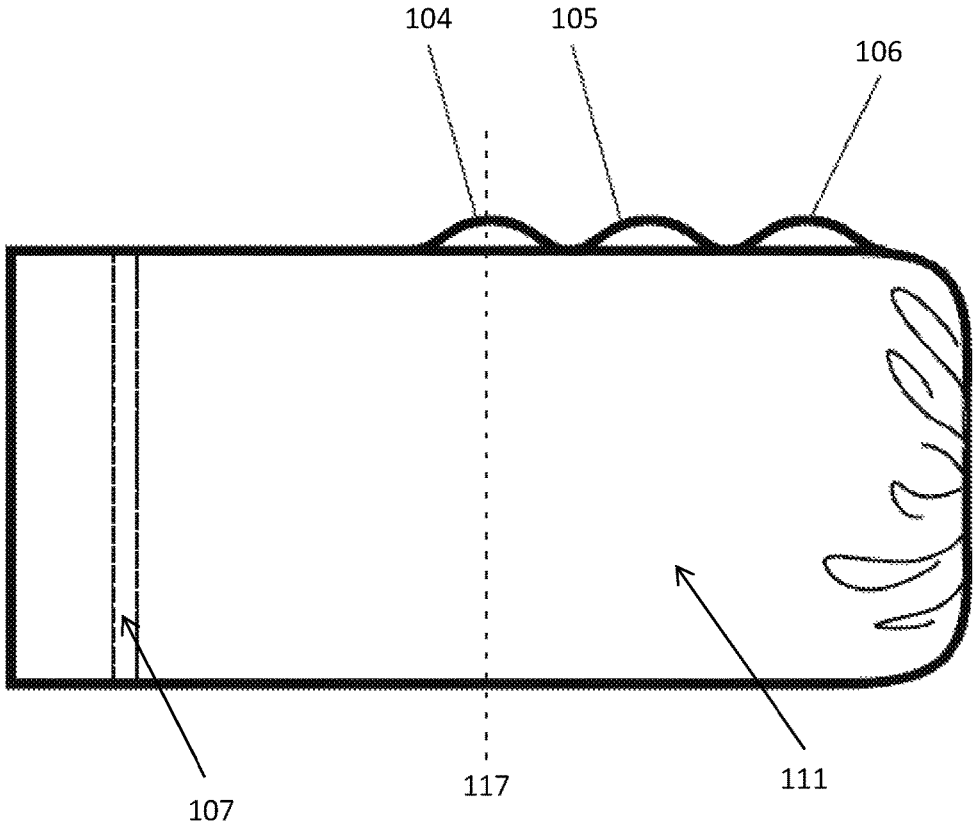
FIG. 14 is an illustrative side-view representation of a collapsible bag having one chamber collapsed in accordance with embodiments of the present invention.
Figure 15:
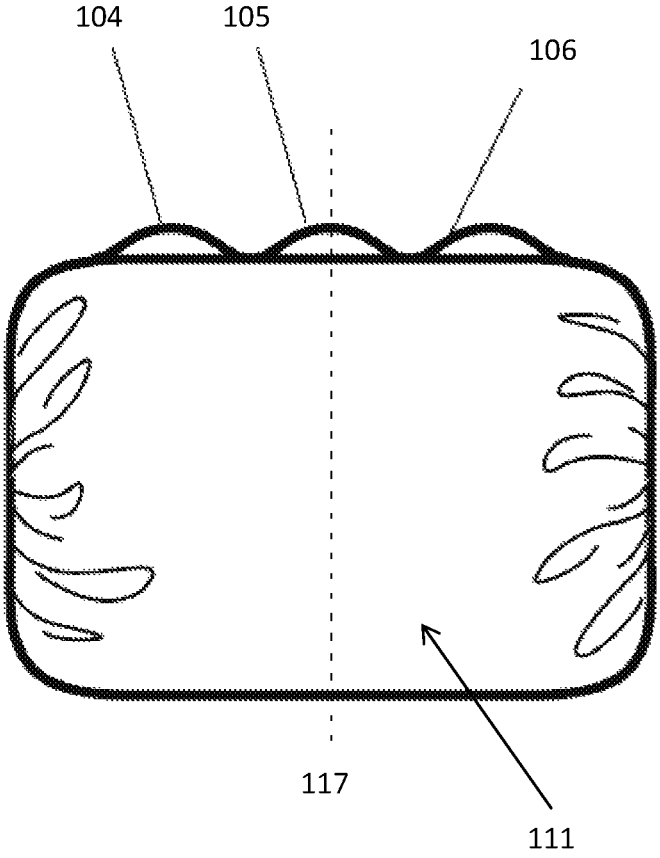
FIG. 15 is an illustrative side-view representation of a collapsible bag having two chambers collapsed in accordance with embodiments of the present invention.

Referring to FIGS. 1-15 the bag of the present invention is illustrated in a step-wise manner from the bag's expanded position in FIG. 1 to its fully tucked and smallest embodiment/position in FIGS. 10 and 15.

The design is an expandable/collapsible bag 111 that can be configured into three different sizes—small medium, and large. It is of cylindrical shape, has three interconnected chambers 101, 102, and 103, a zipper 109 and 110 running along its entire length, three handles 104, 105, and 106 on top, and two drawstrings 107 and 108.

When the collapsible bag is in its large configuration as shown in FIG. 1, all chambers, chamber A 101, chamber B 102, and chamber C 103, are expanded and accessible. Here, handle B 105 can be used to carry the collapsible bag since, in this configuration, handle B 105 is centered (see 117) at the top. The two side chambers, chamber A 101 and chamber C 103, can collapse inwards into chamber B 102 as show in FIGS. 2-9, allowing the size of the collapsible bag to be reduced. This can be done by collapsing and pushing the material of each side chamber, chamber A 101 and chamber C 103 into chamber B 102 past the line of their adjacent drawstrings, drawstring 1 107 for chamber A 101 and drawstring 2 108 for chamber C 103. Once the collapsed material from each side chamber A 101 and chamber C 103 is completely inside chamber B 102, then, their adjacent drawstrings 107 and 108 can be cinched or pulled tight to close the ends of the collapsible bag. This keeps the collapsed material from the side chamber A 101 and chamber C 103 inside chamber B 102 and prevents the collapsible bag from expanding when in use.

There are two medium configurations, 1 and 2, and collapsing any one of the two side chambers, chamber A 101 and chamber C 103 transforms the bag to one of the two medium configurations. There is no specific order as to which side chamber A 101 and chamber C 103 should be collapsed first. Since the bag is symmetric, both medium configurations are of equal size. However, visually, one has a cinched drawstring on one end and the other on the opposite end.

Collapsing only chamber A 101 transforms the collapsible bag to medium configuration 1 (see 113), where the collapsible bag is the length of chamber B 102 and chamber C 103, and chamber B 102 and chamber C 103 are expanded and accessible. Here, handle C1 106 can be used to carry the collapsible bag since, in this configuration, handle C 106 is centered at the top. Collapsing only chamber C 103 transforms the collapsible bag to medium configuration 2, where the collapsible bag is the length of chamber A 101 and chamber B 102, and chamber A 101 and chamber B 102 are expanded and accessible. Here, handle A 104 can be used to carry the collapsible bag since, in this configuration, handle A 104 is centered at the top.

Collapsing both side chambers, chamber A 101 (see 113) and chamber C 103 (see 115), transforms the collapsible bag to its small configuration. In this configuration, the collapsible bag is only the size of chamber B 102, and only chamber B 102 is expanded and accessible. Here, handle B 105 can be used to carry the collapsible bag since, in this configuration, handle B 105 is centered at the top.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A collapsible bag comprising:

a chamber;

a first side chamber, interconnected with the chamber, the first side chamber disposed along and coupled with a first end of the chamber;

a second side chamber, interconnected with the chamber, the second side chamber disposed along and coupled with a second end of the chamber;

a first drawstring element disposed around and along a surface of the collapsible bag and positioned along the first end of the chamber;

a second drawstring element disposed around and along the surface of the collapsible bag and positioned along the second end of the chamber; and a plurality of handles disposed along a top of the collapsible bag, wherein a first of the plurality of handles is centered with the chamber, wherein a second of the plurality of handles is centered with the chamber and the first side chamber, and wherein a third of the plurality of handles is centered with the chamber and the second side chamber.

2. The collapsible bag of claim 1, further comprising:

a zipper positioned along a length of a long axis of the collapsible bag.

3. The collapsible bag of claim 1, wherein the collapsible bag is cylindrical in shape.

4. A method of using a collapsible hag comprising:

providing a collapsible bag, the collapsible bag including, a chamber, a first side chamber, interconnected with the chamber, the first side chamber disposed along and coupled with a first end of the chamber, a second side chamber, interconnected with the chamber, the second side chamber disposed along and coupled with a second end of the chamber, a first drawstring element disposed around and along a surface of the collapsible bag and positioned along the first end of the chamber, and a second drawstring element disposed around and along the surface of the collapsible bag and positioned along the second end of the chamber, collapsing the first side chamber into the chamber;

cinching the first drawstring element to capture the first side chamber within the chamber;

collapsing the second side chamber into the chamber; and cinching the second drawstring element to capture the second side chamber within the chamber.

5. The method of claim 4, further comprising:

loosening the second drawstring element; and expanding the second side chamber out of the chamber.

6. The method of claim 4, further comprising:

loosening the first drawstring element; and expanding the first side chamber out of the chamber.

* * * * *